US011519182B2

(12) United States Patent
Rae et al.

(10) Patent No.: US 11,519,182 B2
(45) Date of Patent: Dec. 6, 2022

(54) FIRE RATED GLASS FLOORING

(71) Applicants: ELY HOLDINGS LIMITED, Oldham (GB); RBCD HOLDINGS LTD., Port Coquitlam (CA)

(72) Inventors: Michael Scott Rae, Oldham (GB); Ryan Bruce Charles Dennett, Port Coquitlam (CA)

(73) Assignees: ELY HOLDINGS LIMITED, Oldham (GB); RBCD HOLDINGS LTD., Port Coquitlam (CA)

( * ) Notice: Subject to any disclaimer, the term of this patent is extended or adjusted under 35 U.S.C. 154(b) by 0 days.

(21) Appl. No.: 16/972,292

(22) PCT Filed: May 30, 2019

(86) PCT No.: PCT/GB2019/051484
§ 371 (c)(1),
(2) Date: Dec. 4, 2020

(87) PCT Pub. No.: WO2019/234394
PCT Pub. Date: Dec. 12, 2019

(65) Prior Publication Data

US 2021/0115676 A1 Apr. 22, 2021

(30) Foreign Application Priority Data

Jun. 4, 2018 (GB) ..... 1809091

(51) Int. Cl.
*E04F 15/02* (2006.01)
*E04F 15/10* (2006.01)
(Continued)

(52) U.S. Cl.
CPC .. *E04F 15/02016* (2013.01); *E04F 15/02044* (2013.01); *E04B 5/10* (2013.01);
(Continued)

(58) Field of Classification Search
CPC ..... E04F 15/02016; E04F 15/02044; E04F 15/107; E04F 15/181; E04B 5/46;
(Continued)

(56) References Cited

U.S. PATENT DOCUMENTS 8,683,764 B2 * 4/2014 Smith ..... E04C 1/42 52/308
8,893,446 B2 * 11/2014 Mathijssen ..... E06B 1/36 52/213
(Continued)

FOREIGN PATENT DOCUMENTS

| | | |
|---|---|---|
| CN | 204199607 U | 3/2015 |
| GB | 2373005 A | 9/2002 |
| WO | 9604437 A1 | 2/1996 |

OTHER PUBLICATIONS

PCT Search Report and Written Opinion in PCT/GB2019/051484. dated Jul. 23, 2019. 12 pages.
(Continued)

*Primary Examiner* — Gisele D Ford
(74) *Attorney, Agent, or Firm* — Meunier Carlin & Curfman LLC

(57) ABSTRACT

A fire rated glass flooring system having blast and/or seismic loading resistance, comprising: (a) a plurality of glass flooring units (100*a*, 100*b*), each unit comprising a first layer (116) of glass and a second layer (118) of glass, the two layers being positioned one above the other and separated by one or more load transferring means (120*a*, 120*b*), wherein the first layer of glass is a structural glass and the second layer of glass is a fire rated glass, and having an upper surface and an edge comprising a load-transferring means of the one or more load transferring means; (b) one or more beams (112), arranged, in use, to support the units, wherein, at a boundary between two adjacent flooring units, the two flooring units are arranged, in use, to be secured to a beam
(Continued)

of the one or more beams; and (c) one or more expansion joints (110), each arranged, in use, at the boundary between two adjacent flooring units. Each expansion joint comprises: (i) two clips (200*a,* 200*b*), each clip being arranged, in use, to be connected to the load-transferring means in one of the two flooring units; (ii) a resilient seal (202) arranged, in use, to sit between the two clips, the seal extending substantially to the upper surface of the two units; and (iii) a drainage means (204), the drainage means being located substantially below the seal and the two clips, and arranged, in use, to capture and drain away any liquid which passes the seal.

21 Claims, 5 Drawing Sheets

(51) Int. Cl.

| | |
|---|---|
| ***E04F 15/18*** | (2006.01) |
| ***E04B 5/10*** | (2006.01) |
| ***E04B 5/46*** | (2006.01) |
| ***E06B 3/66*** | (2006.01) |
| ***E06B 3/663*** | (2006.01) |
| ***E06B 3/67*** | (2006.01) |

(52) U.S. Cl.
CPC ..... *E04B 5/46* (2013.01); *E04F 15/107* (2013.01); *E04F 15/181* (2013.01); *E04F 2015/02072* (2013.01); *E04F 2203/026* (2013.01); *E06B 3/66* (2013.01); *E06B 3/663* (2013.01); *E06B 3/6715* (2013.01)

(58) Field of Classification Search
CPC . E04B 5/10; E06B 3/66; E06B 3/6715; E06B 3/663
See application file for complete search history.

(56) References Cited

U.S. PATENT DOCUMENTS

| | | | | |
|---|---|---|---|---|
| 9,441,378 | B1 * | 9/2016 | Conklin | E04D 11/007 |
| 9,909,309 | B1 * | 3/2018 | Conklin | B32B 17/10293 |
| 9,920,532 | B1 * | 3/2018 | Conklin | E06B 3/6715 |
| 9,926,709 | B1 | 3/2018 | O'Keeffe | |
| 2004/0134150 | A1 * | 7/2004 | Rae | E06B 3/6617 52/481.1 |
| 2009/0241466 | A1 * | 10/2009 | Gussakovsky | E06B 9/264 52/786.1 |
| 2016/0145933 | A1 * | 5/2016 | Condon | E06B 3/66 52/204.5 |
| 2016/0168848 | A1 * | 6/2016 | Zago | B32B 17/10045 52/232 |

OTHER PUBLICATIONS

UK Search Report in GB 1 80909 1.0. dated Nov. 29, 2018. 3 pages.

* cited by examiner

FIRE RATED GLASS FLOORING

CROSS REFERENCE TO RELATED APPLICATIONS

This application is a United States National Phase Patent Application of International Patent Application Number PCT/GB2019/051484, filed on May 30, 2019, which claims the benefit of priority to GB Application No. 1809091.0, filed Jun. 4, 2018, each of which is incorporated by reference herein in its entirety.

The present invention relates to fire rated glass flooring which has at least one of, and preferably both of, blast and seismic resistance. Specifically, but not exclusively, the flooring may comprise a plurality of flooring units supported on beams, with expansion joints at the boundaries between at least two of the flooring units. Further, the glass flooring may comprise an integral drainage system to protect the flooring against water ingress. The glass flooring may comprise a sacrificial upper sheet.

BACKGROUND TO THE INVENTION

There are two principal fire rated glass flooring systems currently available. The first system is a double layer system comprising a fire rated glass and a structural glass, wherein the fire rated glass is supported by a first structure positioned at the bottom of a deep steel beam. The top of the beam supports the structural glass, which can be walked upon.

The beam can be "I" section, box section or can be made up of two "T" section beams bolted or welded together.

This double layer system is expensive and its fire insulation capacity is limited to 30 minutes. Furthermore the system is aesthetically unappealing. The need to distance the two layers of glass by the depth of the beam means that when walking on the floor it is possible to see the beam and the first support structures through the structural glass.

Furthermore the depth of the beam obscures the view through the glass floor to a large extent if a person walking on the floor looks through the floor at an angle rather than straight down.

The second system is a single layer system wherein the glass used is a multi-laminate glass. The single layer system is limited to 30 minutes fire insulation and 30 minutes integrity. If the top sheet of the laminate is broken in use, the whole sheet needs to be replaced. Multi-laminate glass is expensive.

GB2373005 (B) discloses a fire rated glass flooring system comprising a first layer of glass which is a structural glass and a second layer of glass which is a fire rated glass, together with a structural frame that supports the system. In this flooring system, the two layers of glass are positioned one above the other, and separated by one or more load transferring means. Preferably the distance from the upper surface of the second layer is less than 50 mm from the lower surface of the first layer, with the structural glass being positioned above the fire resistant glass. The structural glass may be a multi-laminated glass sheet made up from layers of float glass, heat strengthened glass and fully toughened glass bonded together using poly vinyl butyril or a resin. The second layer of glass is preferably supported directly by the structural frame. Each load transferring means comprises a first portion for bearing the load applied to the first layer of glass and a second portion for transmitting the load applied to the first layer of glass to the structural frame. However, issues of blast and seismic resistance were not addressed in this disclosure.

Accordingly, there remains the need for a highly insulating, tough and aesthetic fire rated glass flooring, which also has at least one of blast and seismic resistance.

SUMMARY OF THE INVENTION

According to a first aspect of the invention, there is provided a fire rated glass flooring system having blast and/or seismic loading resistance, comprising:

- a plurality of glass flooring units, each unit comprising a first layer of glass and a second layer of glass, the two layers being positioned one above the other and separated by one or more load transferring means, wherein the first layer of glass is a structural glass and the second layer of glass is a fire rated glass, and having an upper surface and an edge comprising a load-transferring means of the one or more load transferring means;
- one or more beams, arranged, in use, to support the units, wherein, at a boundary between two adjacent flooring units, the two flooring units are arranged, in use, to be secured to a beam of the one or more beams; and
- one or more expansion joints, each arranged, in use, at the boundary between two adjacent flooring units. Each expansion joint comprises:
  - two clips, each clip being arranged, in use, to be connected to the load-transferring means in one of the two flooring units;
  - a resilient seal arranged, in use, to sit between the two clips, the seal extending substantially to the upper surface of the two units; and
  - a drainage means, the drainage means being located substantially below the seal and the two clips, and arranged, in use, to capture and drain away any liquid which passes the seal.

The skilled person will appreciate that blast considerations are not always required in building specifications, and that the applicability of seismic considerations may depend on building location.

The resilient seal may be made of structural silicone.

Each clip may be a continuous clip with a length equal to or greater than 90% of the flooring unit's length. Optionally, each continuous clip may have an indented portion, the indented portion having a substantially flat portion substantially parallel to the length of the clip.

Each clip may comprise a substantially U-shaped portion and two outwardly-directed flanges extending from the prongs of the substantially U-shaped portion. Further, the middle section of the substantially U-shaped portion of each clip may be secured to the load-transferring means of one of the plurality of glass flooring units.

In some such embodiments, in use, one of the two flanges may point upwards, i.e. towards the upper surface of the units, and the other of the two flanges may point downwards. Further, the resilient seal may be arranged, in use, to sit between the upward-pointing flanges of two adjacent clips. Additionally or alternatively, the downward-pointing flanges may be positioned above the drainage means and may be arranged, in use, to direct any liquid which passes the seal into the drainage means.

In one embodiment the load-transferring means of each flooring unit may comprise a member that extends substantially horizontally and which is located between the first layer of glass which is a structural glass and the second layer of glass which is a fire rated glass. Described another way, the first layer of glass which is a structural glass is located higher than the horizontal member and the second layer of glass which is a fire rated glass is located lower than the horizontal member. It may be that the horizontal member is aligned between the first layer of glass which is a structural glass and the second layer of glass which is a fire rated glass, such that there is glass both directly vertically above and directly vertically below the member. It may alternatively be that the member is between the layers of glass but offset from one or both layers of glass. For example, in one embodiment the first layer of glass, which is a structural glass, is located higher than and aligned with the horizontal member whilst the second layer of glass, which is a fire rated glass, is located lower than and offset from the horizontal member, such that there is glass directly vertically above the member but not directly vertically below the member.

The load-transferring means of each flooring unit may comprise a hollow box.

The load-transferring means of each flooring unit may be positioned on a plate forming part of the corresponding flooring unit. The plate may be between the load-transferring means and the beam, and may extend substantially horizontally from the edge of the load-transferring means nearest to the boundary between flooring units to beyond the opposite edge of the load-transferring means. Further, a second resilient seal may be arranged on the plate, between the plate and a layer of glass forming the lower surface of the remainder of the unit. In such embodiments, the second resilient seal may be made of structural silicone.

In embodiments with a plate, the plate may form the lowest portion of the lower surface of the flooring unit, and may extend substantially to the edge of the beam by which it is supported.

The drainage means may be arranged, in use, to channel any liquid which passes the seal to one or more edges of an area covered by the flooring system.

The drainage means may comprise a channel located substantially below the seal and the two clips, and running along the top of the beam, at the boundary between adjacent units. Each channel may be sloped towards an edge of an area covered by the flooring system.

A replaceable, sacrificial sheet may be provided on the upper surface of the flooring system. Advantageously, this may allow cost effective replacement of damaged/worn glass in service.

Each flooring unit may be sealed so as to be substantially air-tight.

Each flooring unit may be sealed so as to be substantially water-tight.

The beam may be a T-beam or an I-beam. The two adjacent flooring units may be arranged, in use, to be secured to opposing flanges of the T or I beam.

The beam may be a T-beam.

DESCRIPTION OF THE DRAWINGS

Embodiments of the present invention will now be described in more detail with reference to the figures, in which.

DETAILED DESCRIPTION OF THE INVENTION

Figure 1:
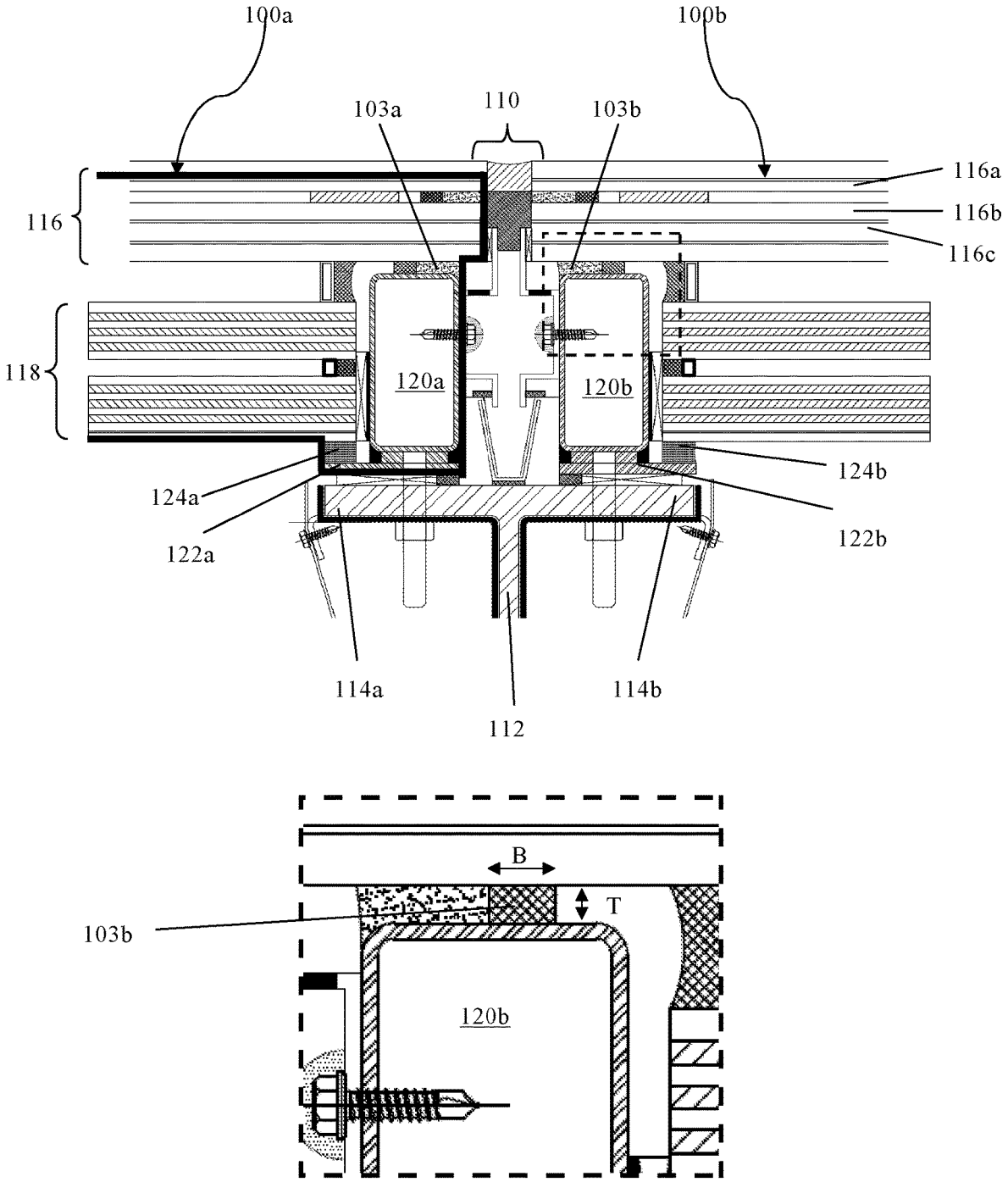
FIG. 1 shows a cross section through a fire rated glass-flooring system of an embodiment, and an expanded view of a portion thereof.

FIG. 1 shows the adjacent edges of two flooring units 100*a*, 100*b* and an expansion joint 110 between them. A thick black line is provided to mark the edges of one flooring unit 100*a* for ease of reference.

Figure 5:
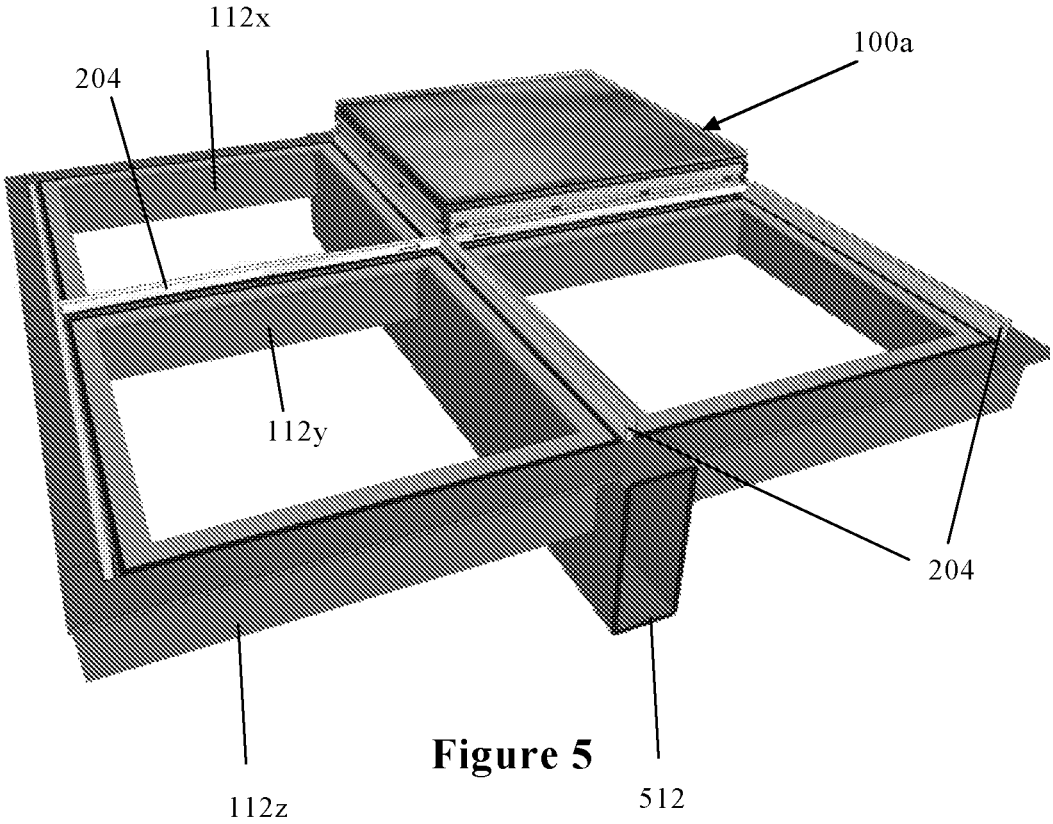
FIG. 5 shows a single unit, in place on a beam.

The skilled person would understand that expansion joints 110 may be provided between at least one, some or all of the pairs of adjacent units 100*a*, 100*b* within a flooring system, and more particularly between the adjacent edges of the pairs of adjacent units 100*a*, 100*b*. For square units of equal size 100*a* arranged to have aligned corners as shown in FIG. 5, each unit 100*a*, 100*b* may have up to four adjacent units 100*a*, 100*b*, and therefore up to four expansion joints 110 as described herein. For hexagonal units of equal size (not shown), each unit may have up to six expansion joints 110 as described herein. In some cases, a unit 100*a*, 100*b* may have more adjacent units and/or expansion joints 110 than edges. Where units 100*a*, 100*b* of differing sizes are used, for example, more than one smaller unit may be adjacent to one larger unit along the same edge of the larger unit.

Figure 2:
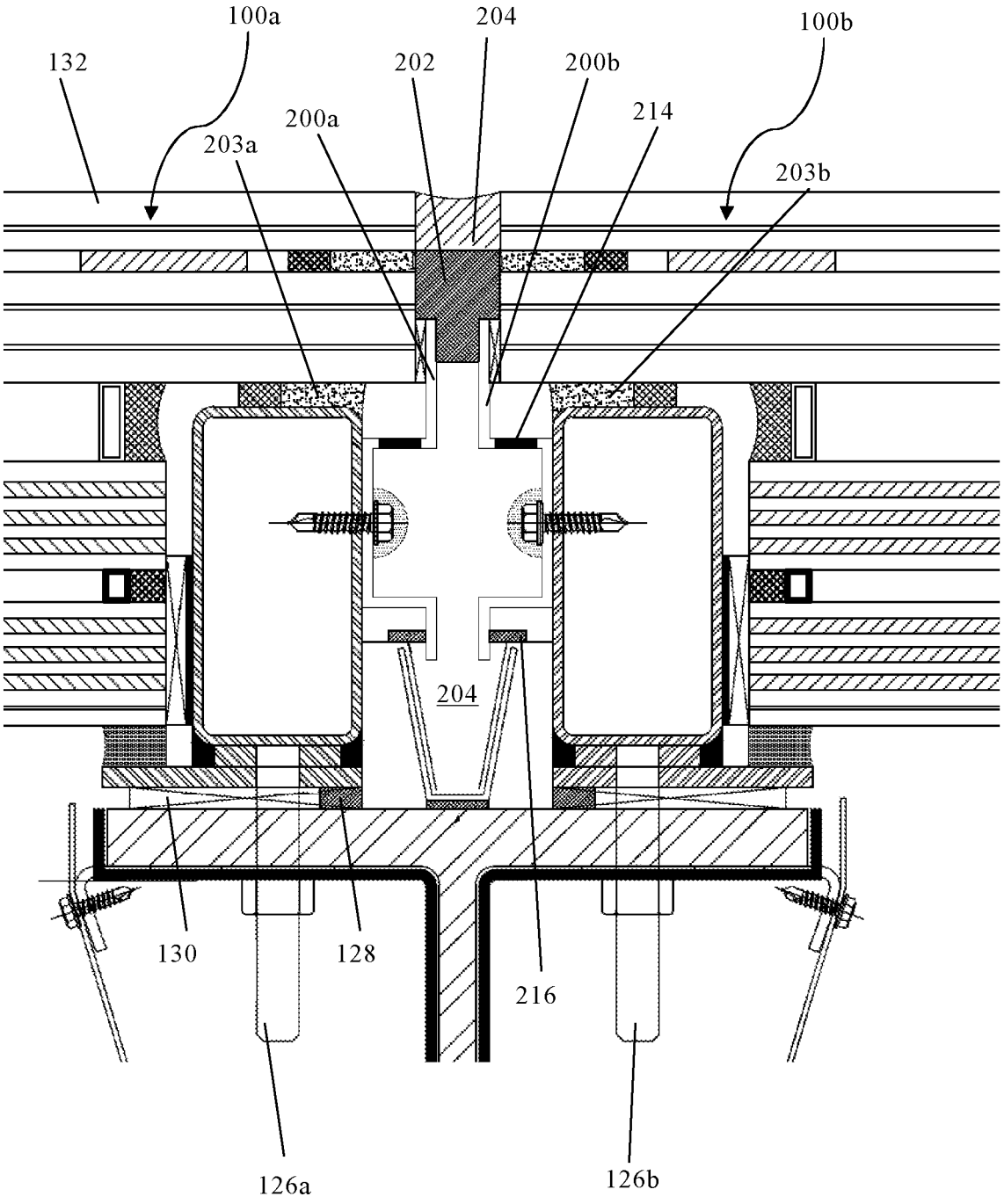
FIG. 2 shows a close-up of the cross section of the joint region through the glass-flooring system of the embodiment of FIG. 1.
Figure 3:
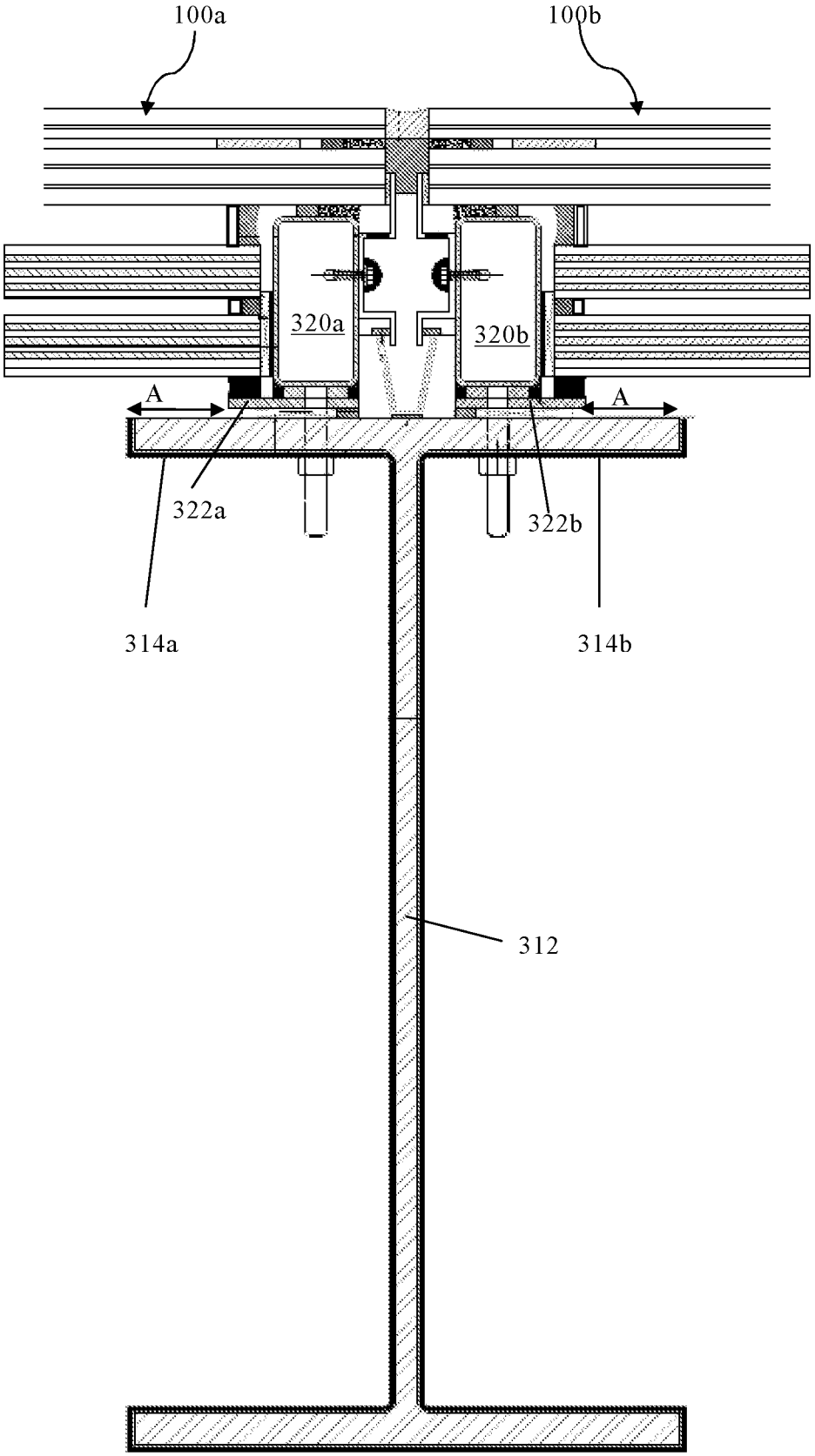
FIG. 3 shows a cross section through a fire rated glass-flooring system of an embodiment wherein an I-beam is used.

The gap between adjacent edges of an adjacent pair of flooring units 100*a*, 100*b* (which is approximately equivalent to the width of the expansion joint 110 in the embodiments shown in FIGS. 1, 2 and 3) is typically between 2 cm and 5 cm. In alternative or additional embodiments, the spacing between adjacent edges of an adjacent pair of flooring units 100*a*, 100*b* may be up to 50 cm, but is preferably below 20 cm, and more preferably below 10 cm.

In some embodiments, different beam types and/or joint types may be used on different edges of the same flooring unit 100*a*, 100*b*. For example, a square unit 100*a*, 100*b* in the corner of a floored area may have expansion joints 100*a* on the two edges in contact with other flooring units 100*a*, 100*b* and an alternative joint on the remaining two edges.

In the embodiment being described, a T-beam 112 is located beneath the two flooring units 100*a*, 100*b*, and parallel to the boundary between the flooring units. The two flooring units 100*a*, 100*b* are secured to the T-beam 112. In the embodiment being described, the two flooring units 100*a*, 100*b* are secured to the T-beam 112 with screws.

The T-beam has two flanges 114*a*, 114*b*. Each flange 114*a*, 114*b* is located beneath, and secured to, one of the two units 100*a*, 100*b*. In the embodiment being described the expansion joint 110 is aligned with the centre of the T-beam.

In alternative embodiments, the boundary between the units 100*a*, 100*b* may be offset from the centre of the beam 112 such that both units 100*a*, 100*b* are secured to the same flange 114*a*, 114*b*.

The skilled person would understand that, in some embodiments, an alternative beam or girder may be used in place of the T-beam 112. For example, an I-beam or a box girder may be used. Further, within a flooring area, more than one beam type may be used.

Each unit 100*a*, 100*b* comprises at least two layers of glass 116, 118; a structural glass layer, and a fire rated glass layer. Each unit 100*a*, 100*b* further comprises at least one load transferring means 120*a*, 120*b* between the layers, together with a structural frame supporting the unit 100*a*, 100*b*. Optional details for these units 100*a*, 100*b* are described in an earlier patent, GB2373005 (B).

In the embodiment being described, the first 116 and second 118 glass layers are parallel to each other.

Preferably the first and second layers 116, 118 of glass are spaced less than 50 mm apart, more preferably less than 40 mm apart and most preferably between 30 mm and 10 mm apart, for example 30 mm, 28 mm, 20 mm, 13.5 mm or 10 mm apart. The spacing is measured from the upper surface of the second layer to the lower surface of the first layer.

In the embodiment being described, the structural glass layer 116 is provided above the fire rated glass layer 118. Advantageously, in use the structural, load bearing glass layer 116 is on top to bear the load applied thereto and the fire rated glass layer 118 is below to delay the spread of fire. In alternative embodiments, the structural glass layer 116 may be provided below the fire rated glass layer 118.

A suitable type of structural glass is multi-laminated glass sheet made up of layers of float glass, heat strengthened glass and fully toughened glass bonded together using poly vinyl butyral (PVB) or a resin. A particularly suitable glass of this type is Eckelt LITEFLOOR 33 mm triple laminate glass bonded together with polyvinyl butyril.

Particularly suitable fire rated glass includes sgg CONTRAFLAM® LITE, 17 mm thick, sgg CONTRAFLAM® EI30, 21 mm thick, sgg CONTRAFLAM®-N2, 39 mm thick, and Contraflam XT120 81 mm thick, although other fire rated glasses can be used depending on their fire rating properties.

The skilled person would understand that other glasses known in the art may be used in place of, or in addition to, the examples listed above.

The first 116 and second 118 layers preferably each comprise a number of co-extensive sheets of glass (e.g. 116*a-c*). The structural frame preferably comprises a number of beams and cross members positioned to support the sheets of glass 116, 118 forming the first and second layers.

Each unit 100*a*, 100*b* is sealed so as to be substantially air-tight. Advantageously, the air-tight sealing, with air gaps between layers of glass 116*a*, 116*b*, 116*c* making up each unit, increases the fire resistance of the flooring.

In the embodiment being described, resilient silicone sealant is used at metal-glass interfaces, and metal-metal interfaces are welded. The skilled person would understand that alternative or additional sealing means could be used.

The or each load transferring means 120*a*, 120*b* is preferably a box shape, and more preferably is a steel box. The load transferring means may be a solid steel box or a hollow steel box and is most preferably a 50 mm×25 mm solid steel box or a 50 mm×30 mm hollow steel box, depending on the type and thickness of fire rated glass used.

The first and second layers of glass are preferably insulated from the load-transferring means 120*a*, 120*b* by appropriate materials.

In the embodiment being described, the load-transferring means of each unit 100*a*, 100*b* comprises a hollow box 120*a*, 120*b*. In the embodiment being described, the hollow boxes 120*a*, 120*b* are made of metal, and preferably of stainless steel.

The skilled person would understand that other structural materials could be used instead. Further, other shapes of load-transferring means 120*a*, 120*b* may be used, for example substantially C- or U-shaped strips, and/or vertical threaded studs or bars and horizontal threaded toggle plates or the likes. The skilled person will appreciate that a horizontal toggle plate may be screwed down onto the vertical threaded bar/stud to a required level and that such a horizontal toggle plate may provide the support to the structural glass and allow the applied loading to bypass the fire rated glass.

In each unit 100*a*, 100*b*, the hollow box 120*a*, 120*b* sits substantially below the first layer 116. The first layer 116 forms the upper surface of the flooring. The hollow box 120*a*, 120*b* sits substantially in line with the second layer 118, such that the hollow box 120*a*, 120*b* sits between the second layer 118 and the boundary between units 100*a*, 100*b*.

In the embodiment being described, each unit 100*a*, 100*b* further comprises a plate 122*a*, 122*b* arranged below the hollow box 120*a*, 120*b*, and between the hollow box 120*a*, 120*b* and the T-beam 112 to which the units 100*a*, 100*b* are connected. The plate 122*a*, 122*b* is wider than the hollow box 120*a*, 120*b*, such that the plate 122*a*, 122*b* extends across more of the unit 100*a*, 100*b* than does the hollow box 120*a*, 120*b*. The edge of the plate 122*a*, 122*b* closest to the boundary between units 100*a*, 100*b* is substantially aligned with the edge of the hollow box 120*a*, 120*b* closest to the boundary between units 100*a*, 100*b*. In the embodiment being described, the hollow box 120*a*, 120*b* is welded to its corresponding plate 122*a*, 122*b*. In alternative embodiments, the plate 122*a*, 122*b* may be provided as part of the corresponding hollow box 120*a*, 120*b*.

In the embodiment being described, the plate 122*a*, 122*b* forms the lowest part of the lower surface of the unit 100*a*, 100*b*. The lower surface of the second layer 118 of glass forms the lower surface of the unit 100*a*, 100*b* in regions over which the plate 122*a*, 122*b* does not extend.

There is a gap between the upper surface of the plate 122*a*, 122*b* and the lower surface of the second layer 118 of glass. In the embodiment being described, a resilient seal 124*a*, 124*b* sits between the upper surface of the plate 122*a*, 122*b* and the lower surface of the second layer 118 of glass. In the embodiment shown, the resilient seal 124*a*, 124*b* is made of structural silicone. Advantageously, this resilient seal 124*a*, 124*b* provides some blast resistance.

The skilled person will appreciate that features which provide blast resistance can differ from those which provide for seismic resistance, as the loading conditions are different.

In the embodiments being described, to provide or improve resistance to blast loading the bite (labeled "B" in FIG. 1) of the horizontal joint 103*a-b*, 203*a-b* between each panel 100*a*, 100*b* and its associated perimeter frame as provided by the hollow box 120*a*, 120*b* (this may be referred to as (structural) silicone bite when (structural) silicone is used for the joint 103*a-b*, 203*a-b*) is relatively large/increased as compared to more standard bites to secure the glass.

The skilled person will appreciate that structural silicone bite is the minimum width or contact surface of the silicone sealant on both the panel and frame. Increasing the bite (width) will increase the capacity.

The thickness (depth, labeled "T" in FIG. 1) of such horizontal joints is typically between 6 mm and 10 mm, and sometimes as high as 20 mm, in the prior art depending on project geometry and aesthetics.

The silicone bite of such horizontal joints is typically between 6 mm and 10 mm in the prior art.

In the embodiment being described, a ¼" (6 mm) thickness was used as standard, and a 1" (25 mm) bite or width was used. The skilled person will appreciate that the larger bite may improve blast resistance.

Additionally or alternatively, larger beams and/or main supports (e.g. box girders 512 and T- or I-section beams 112) may be used in various embodiments due to blast considerations. Foundations may also be made deeper. Blast resistance considerations may therefore significantly increase system size, weight, and/or depth.

High seismic demands will also call for transferring of seismic load into the structure. Increased resilient seal widths can improve seismic loading resistance, like blast resistance.

In the embodiments disclosed herein, the clip 200*a*, 200*b* provides some seismic loading resistance; increased seal widths may not be needed to meet seismic load requirements in some embodiments.

Slotted connections, i.e. replacement of a hole for a bolt or screw with a slot to allow some movement in one direction, can be used to allow for some movement between units so as to potentially reduce damage from seismic events. In the embodiments being described, horizontally slotted holes (as opposed to vertical) are used as vertical slots would allow the floor to drop vertically within the slot depth which would not facilitate maintenance of a level floor.

In the embodiments being described, support/structural members generally have one fixed end (bolt/screw holes) and one slotted end (horizontal slot for bolts/screws) to assist in meeting seismic loading requirements. In some embodiments, every support member, whether it is for example a main transverse box sections or individual I- or T-section beam, has a fixed connection at one end and a slotted connection at the other.

In at least some embodiments, for example in embodiments in which blast resistance and fire resistance but not seismic load resistance are provided, horizontal slots are provided at both ends of the structural support members, and also in the end fin plates which attach the support members to the structural surround. The skilled person will appreciate that this may allow thermal expansion of the structural members in a fire—structural members such as box girders and T- and I-beams can expand lengthways and expansion capability of the system may allow this to happen without buckling.

In some embodiments, seismic loading requirements may preclude the use of horizontal slots in both ends as there could be too much room for movement under seismic forces. Therefore, in the embodiment described above, the thermal expansion capability was reduced by providing only one end of each structural member with a horizontal slot, and the other with a fixed connection. The skilled person will appreciate that the ratios of slotted connections to fixed connections may vary in other embodiments.

In the embodiment being described, the edge of the plate 122*a*, 122*b* closest to the boundary between units 100*a*, 100*b* is substantially aligned with the edge of the hollow box 120*a*, 120*b* closest to the boundary between units 100*a*, 100*b*.

In the embodiment being described, the edge of the plate 122*a*, 122*b* furthest from the boundary between units 100*a*, 100*b* is substantially aligned with the outer edge of the flange 114*a*, 114*b* of the T-beam 112. Advantageously, the alignment of the edge of the plate 120*a*, 120*b* with the outer edge of the flange 114*a*, 114*b* helps to reduce thermal shock to the unit 100*a*, 100*b*, so increasing fire/heat resistance.

In the embodiment being described, each hollow box 120*a*, 120*b* is connected to the flange 114*a*, 114*b* of the T-beam 112 which supports it. In the embodiment being described, each hollow box 120*a*, 120*b* is connected to the flange 114*a*, 114*b* by means of a bolt 126*a*, 126*b*. The bolt 126*a*, 126*b* passes through the plate 120*a*, 120*b*, between the hollow box 120*a*, 120*b* and the corresponding flange 114*a*, 114*b*. In alternative embodiments, other connecting means may be used, as would be understood by one skilled in the art.

In the embodiment being described, a silicone air-seal gasket 128 and a steel shim 130 are also provided, between each flange 114*a*, 114*b* and the corresponding plate 120*a*, 120*b*. In the embodiment being described, the silicone air-seal gasket 128 and the steel shim 130 are each in contact with both the plate 120*a*, 120*b* and the corresponding flange 114*a*, 114*b*.

In the embodiment being described, a sacrificial sheet 132 is provided on top of each unit 100*a*, 100*b*. Advantageously, the sacrificial sheet 132 forms the layer of flooring exposed to wear (e.g. from feet of people walking thereon) and damage (e.g. from stiletto heels and/or from spilled drinks) and can be cheaply and easily replaced, so improving the durability of the underlying flooring system.

In the embodiment being described, the sacrificial sheet 132 is made from laminated glass. The sacrificial sheet 132 may comprise multiple glass sheets laminated together, for example two glass sheets. The glass sheets may each have thicknesses of between 6 mm and 10 mm. The sheets may be laminated together with Polyvinyl butyral (PVB), for example using a thickness of PVB of around 1-2 mm, and optionally around 1.52 mm. In other embodiments, other suitable materials known to one skilled in the art may be used instead of, or as well as, glass.

In some embodiments, a slip resistant ceramic frit is fused to the uppermost surface of the sacrificial sheet 132. The ceramic frit may be provided in a standard colour and pattern, or in an optional variety of colours and/or patterns as desired.

As part of the expansion joint 110 between units 100*a*, 100*b*, a clip 200*a*, 200*b* is provided for each unit 100*a*, 100*b*.

In the embodiments being described, each clip 200*a*, 200*b* is a continuous clip. A continuous clip 200*a*, 200*b* is a clip which extends substantially the entire length of the unit 100*a*, 100*b* to which it is connected. For example, the continuous clip 200*a*, 200*b* may cover over 90%, and preferably over 95% of the unit's 100*a*, 100*b* edge length.

In the embodiments being described, each continuous clip 200*a*, 200*b* runs substantially along the length of the unit 100*a*, 100*b*.

In alternative or additional embodiments, intermittent clips may be used in place of some or all of the continuous clips 200*a*, 200*b*. In such embodiments, the clips could be have portions of equal or unequal lengths, and/or the ratio of clip length to space between clips may be, for example, 1:1 or 1:4.

In the embodiment being described, each clip 200*a*, 200*b* is substantially the same length as the unit 100*a*, 100*b* to which, in use, it is attached.

In alternative or additional embodiments, the clips 200*a*, 200*b* may be longer than a single unit 100*a*, 100*b*, such that multiple units 100*a*, 100*b* can be connected to the same clip 200*a*, 200*b*.

In embodiments wherein the continuous clip 200*a*, 200*b* is longer than a single unit 100*a*, 100*b*, a single continuous clip may be used for 2, 3, 4 or more units 100*a*, 100*b*, for example. In some embodiments, the continuous clip 200*a*, 200*b* may have substantially the same length as the beam 112 on which it is positioned, in use.

The skilled person would understand that shorter clips (relative to unit length) could be used, and that a larger number of clips per unit may be needed in embodiments wherein shorter clips are used.

Each continuous clip 200*a*, 200*b* has an indented portion. The indented portion of the continuous clip is connected to the hollow box 120*a*, 120*b*.

In the embodiment being described, the indented portion has a substantially flat portion substantially parallel to the length of the continuous clip 200*a*, 200*b*. The substantially flat portion of the indented portion of each continuous clip 200*a*, 200*b* is connected to the corresponding hollow box 120*a*, 120*b*. In the embodiment shown, one or more self-tapping screws are used to connect the continuous clip 200*a*, 200*b* to the hollow box 120*a*, 120*b*. The skilled person would understand that different types of screws or bolts, or alternative connecting means, may be used in other embodiments. Additionally or alternatively, the continuous clip 200*a*, 200*b* and the hollow box 120*a*, 120*b* may be welded together.

In the embodiment being described, the cross-section of each continuous clip 200*a*, 200*b* is substantially U-shaped, with two outwardly-directed flanges extending from the prongs of the substantially U-shaped portion. The two outwardly-directed flanges are substantially parallel to each other, and to the bottom of the U-shaped portion.

In the embodiment being described, in use, one of the two flanges from each continuous clip 200*a*, 200*b* points upward towards the upper surface of the units 100*a*, 100*b*, and the other of the two flanges points downwards.

A resilient seal 202 sits between the upward-pointing flanges of two adjacent continuous clips 200*a*, 200*b*. The resilient seal 202 is T-shaped, such that the stem of the T sits between the flanges of the two adjacent continuous clips 200*a*, 200*b* and the top of the T sits across the tops of the flanges, so that the resilient seal 202 cannot slip down between the flanges in normal use. In the embodiment being described, the resilient seal 202 is made of structural silicone, and, more specifically, is an extruded silicone gasket backer. Advantageously, the resilient seal 202 increases the blast loading resistance of the flooring system. In the embodiment being described, the resilient seal 202 comprises weep slots to allow any moisture gathering on it to pass through.

The downward-pointing flanges of the two adjacent continuous clips 200*a*, 200*b* are arranged above a drainage means 204.

In the embodiments being described, the drainage means 204 comprises at least one channel. The or each channel 204 runs parallel to an expansion joint 110. Each channel 204 runs substantially the entire length of an expansion joint 110, for example at least 90%, 95% or 99% of the expansion joint 110 length, or to within 5 mm or 10 mm of the end of the expansion joint 110. The drainage means 204 may therefore be described as a continuous drainage means 204 as it is substantially continuous with the expansion joint 110.

In at least some embodiments, the one or more channels of the drainage means 204 may each comprise a plurality of interlinked sections. The skilled person would understand that providing a channel 204 in a series of sections may facilitate assembly. The sections may be linked so as to form a continuous channel 204.

In the embodiment being described, the continuous clips 200*a*, 200*b* comprise weep holes 214 to allow any liquid which has passed the resilient seal 204 through to the continuous drainage means 204. In the embodiment being described, the weep holes 214 in the continuous clips 200*a*, 200*b* are provided only in the uppermost side of the U-shaped portion of each clip 200*a*, 200*b*. Liquid on top of each continuous clip 200*a*, 200*b* may therefore pass into the space between the clips 200*a*, 200*b* via the weep holes 214, but may only drain out of that space under gravity via the gap between the two downward-pointing flanges of the pair of adjacent continuous clips 200*a*, 200*b*.

Figure 4:
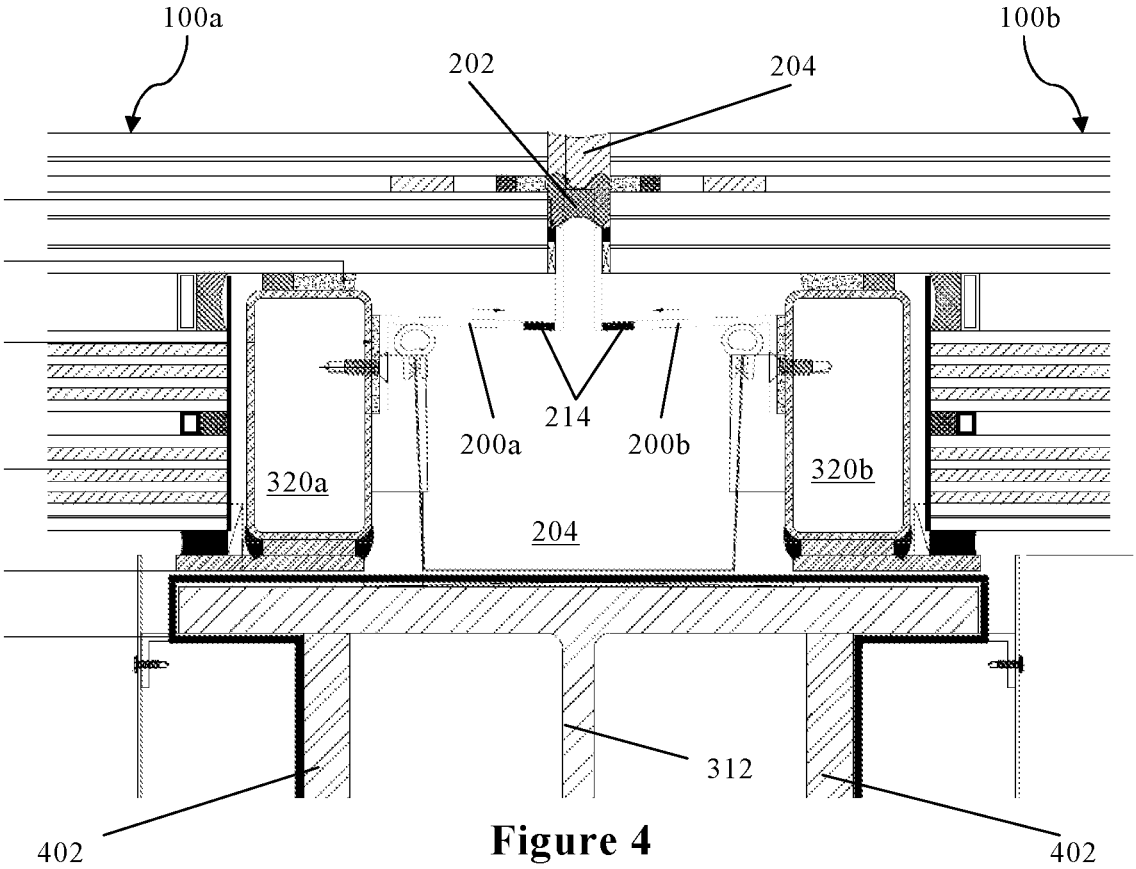
FIG. 4 shows a cross section through a fire rated glass-flooring system of a further embodiment wherein an I-beam is used, wherein the units of the flooring system are more widely spaced.

In the embodiment being described, the upper (approximately horizontal) surface of each continuous clip is arranged to facilitate any water falling onto the continuous clip being directed towards the weep holes 214; as shown in FIG. 4, the upper surface is angled towards the weep holes 214 in the embodiment shown so that water can flow downwards into the weep holes 214.

Further, in the embodiment being described, silicone airseal gaskets 216 are adhered to a lower portion of each clip 200*a*, 200*b*, blocking access to regions other than the continuous drainage means 204. In the embodiment being described each gasket 216 is connected to the downward-pointing flange of a continuous clip 200*a*, 200*b*, and is substantially perpendicular to the downward-pointing flange (i.e. substantially horizontal). Each gasket 216 extends from the downward-pointing flange of the continuous clip 200*a*, 200*b* to which it is connected and towards the unit 100*a*, 100*b* to which the continuous clip 200*a*, 200*b* to which it is connected is attached.

In the embodiment being described, the gaskets 216 are connected to vertical faces of the downward-pointing flanges. In alternative or additional embodiments, the gaskets 216 may be connected to the underside of the downward-pointing flange.

Advantageously, these gaskets 216 may prevent liquid gathering in non-drained regions of the expansion joint 110. The skilled person would understand that alternative seals or caps could be used.

In the embodiment being described, the continuous drainage means 204 comprises a channel or gutter which runs along the T-beam, parallel to the boundary between units 100*a*, 100*b*. Any liquid (e.g. condensation or rain water entering the expansion joint due to a leak) is directed into the continuous drainage means 204. The channels of the continuous drainage means 204 are sloped such that any liquid therein is directed to an edge of the flooring, from where it can be disposed of in any suitable manner (e.g. by means of a drainpipe, or joining a pipe containing greywater from another source).

In the embodiment being described, the gaskets 216 extend from the continuous clips 200*a*, 200*b* and beyond the width of the channel 204. Advantageously, these gaskets 216 may prevent liquid which evaporates from the channel 204 entering non-drained regions of the expansion joint 110. For example, condensation may form on the underside of the gasket 216 and drip back into the channel 204.

The continuous drainage means 204 can be seen in FIGS. 5 and 6, which are described in more detail below.

On top of the resilient seal 202 is a further seal 204, which may be considered to form part of the resilient seal 202. The further seal 204 is also made of structural silicone in the embodiment being described. The further seal 204 extends substantially to the upper surface of the two units 100*a*, 100*b*, or to the upper surface of the sacrificial sheet 132 in embodiments wherein a sacrificial sheet is used.

The embodiment shown in FIG. 1 and FIG. 2 shows two units 100*a*, 100*b* connected to a T-beam 112. In FIGS. 3 and 4, two units 100*a*, 100*b* are shown connected to an I-beam 312. The flanges 314*a*, 314*b* of an I-beam 312 are generally wider than the flanges 114*a*, 114*b* of a T-beam 112. For the same expansion joint 110 arrangement and dimensions as shown in FIGS. 1 and 2, the overlap (marked by arrow A)

of the flanges 314*a*, 314*b* with the units 100*a*, 100*b* is therefore greater, such that the flanges 314*a*, 314*b* of the I-beam extend beyond the plate 322*a*, 322*b*. In such embodiments, extensive research and calculations demonstrated that thermal shock in the overlap section (marked A) can cause cracking and premature failure of the fire rated glass layer 116, so reducing fire resistance.

Although the person skilled in the art might generally design a join with the units 100*a*, 100*b* located closely together for structural reasons, design choices for fire resistance are prioritized in the overlap of the embodiment shown in FIG. 4, with structural considerations taken into account elsewhere in the design.

In the embodiment shown in FIG. 4, the units 100*a*, 100*b* are therefore more widely separated on the I-beam 312 such that the edge of the plate 322*a*, 322*b* closest to the boundary between units 100*a*, 100*b* is substantially aligned with the edge of the hollow box 320*a*, 320*b* closest to the boundary between units 100*a*, 100*b*, as in the case of the T-beam 112 (FIGS. 1 and 2). The drainage channel 204 is wider between the hollow boxes 320*a*, 320*b* units 100*a*, 100*b* as a consequence. The continuous clips 200*a*, 200*b* are therefore differently proportioned to accommodate the different spacing, given that the drainage channel 204 remains approximately the same width between the layers of glass 116 in this embodiment. In this embodiment, steel reinforcement plates 402, each coated with an intumescent coating, are provided on each side of the I-beam 312. In the embodiment shown, bolts 126 are not visible in the section shown in FIG. 4, but are present on the other three sides of the units 100*a*, 100*b*. In the embodiment being described, bolts 126 are not located on the box sections. The units shown in FIG. 4 are instead secured to the structural T- or I-section beams on the other three sides.

Figure 6:
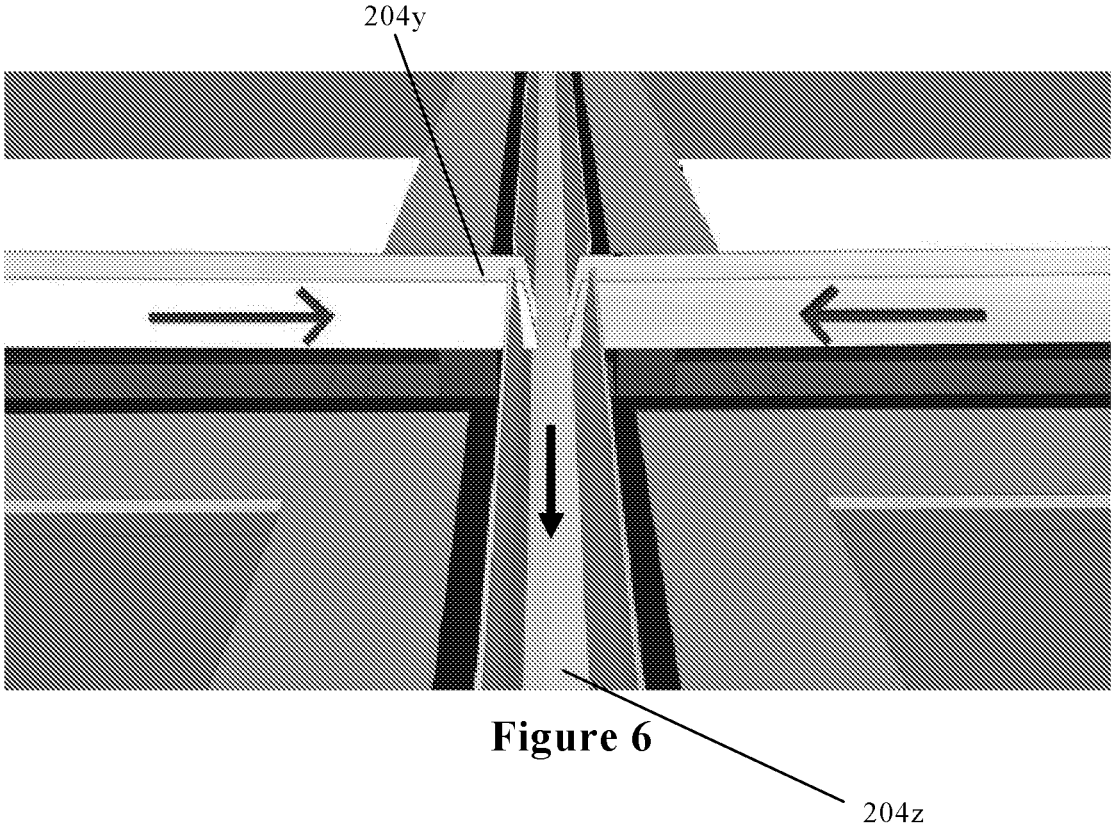
FIG. 6 shows a close-up of the drainage channels of the embodiment shown in FIG. 5.

Returning to the continuous drainage means 204, FIG. 5 shows one unit 100*a* in place on a frame designed to take four units, showing the drainage channels 204 in context, and FIG. 6 shows a close-up of an intersection between drainage channels 204 according to one embodiment.

In the embodiment being described, a lower end of the downward-pointing flanges of each continuous clip 200*a*, 200*b* is within the drainage channel 204. Advantageously, any liquid within the continuous clips 200*a*, 200*b* is therefore directed to the drainage channel 204. Further, the airseal gaskets 216 are connected to the outer side of each downward-pointing flange and to the top of the drainage channel 204, so sealing the gap and preventing water ingress into the non-drained regions of the expansion joint 110.

FIG. 5 shows three parallel T-beams 212*x*, 212*y*, 212*z*, all arranged perpendicular to a central box girder 512 (or box-section beam). The T-beams 212*x*, 212*y*, 212*z* and box girder 512 form a frame for a two-by-two square of square units 100*a*, 100*b*. The skilled person would understand that units 100*a*, 100*b* of different shapes may also be envisaged, for example rectangles, other quadrilaterals, triangles, pentagons and hexagons. Combinations of units 100*a*, 100*b* of different shapes may be used within the same flooring system to achieve the desired floor shape and/or appearance.

In the embodiment being described with respect to FIG. 5, the building in which the flooring of the embodiment is installed has a series of major supports (box girders 512) crossing a 36 foot (11 metre) span of the area every 12 feet (3.7 metres). Between these major supports 512 is a 4 ft×4 ft (1.2 m×1.2 m) grid of either structural T- or I-section beams which provides four-sided support to the units a100*a*, 100*b* and allows them to be bolted down on all four sides where there are T- or I-beams all round, or on three sides where one of the sides is a box section of a box girder 512.

Drainage channels 204 run along each beam 212*x*, 212*y*, 212*z* and the box girder 512. The flow direction in each drainage channel 204 is marked by small arrows. The drainage channels 204 are slightly sloped such that any liquid in the channels 204 flows in the direction indicated by the corresponding arrow.

FIG. 6 shows the intersection between two drainage channels, 204*y*, 204*z*, according to one embodiment. In the embodiment shown, channel 204*z* slopes in the direction indicated by the arrow in that channel, and, at least at the intersection between channel 204*y* and channel 204*z*, is lower than channel 204*y*. Channel 204*y* is split into two sections, each of which slopes downwards towards channel 204*z*. All liquid in these channels is therefore collected in channel 204*z*, from where it is drained away. Where channel 204*y* meets channel 204*z*, channel 204*y* has flanges overhanging channel 204*z* to facilitate drainage in the desired direction. The skilled person would understand that intersections of sloped drainage channels 204 can be designed in other ways, and that the embodiment shown in FIG. 6 is provided as a non-limiting example only.

In the embodiments described above, the materials and dimensions of the T-beams 112 and I-beams 312 are generally chosen to exceed the requirements for supporting the flooring structure, so as to provide increased blast and seismic resistance in addition to a standard safety margin.

In addition, intumescent coatings (e.g. intumescent paint) may be used on the T- and I-beams 112, 312 and some or all of the other exposed metal surfaces to improve fire/heat resistance.

The invention claimed is:

1. A fire rated glass flooring system having blast and/or seismic loading resistance, comprising:

a plurality of glass flooring units, each unit comprising a first layer of glass and a second layer of glass, the two layers being positioned one above the other and separated by one or more load transferring means, wherein the first layer of glass is a structural glass and the second layer of glass is a fire rated glass, and having an upper surface and an edge comprising a load-transferring means of the one or more load transferring means, wherein the one or more load transferring means allow applied loading to bypass the fire rated glass;

one or more beams, arranged to support the units, wherein, at a boundary between two adjacent flooring units, the two flooring units are secured to a beam of the one or more beams; and one or more expansion joints, each arranged at the boundary between two adjacent flooring units, and comprising:

two clips, each clip being connected to the load-transferring means in one of the two flooring units;

a resilient seal sitting between the two clips, the seal extending substantially to the upper surface of the two units; and a drainage means, the drainage means being located substantially below the seal and the two clips, and arranged to capture and drain away any liquid which, in use, passes the seal.

2. The fire rated glass flooring system of claim 1, wherein the resilient seal is made of structural silicone.

3. The fire rated glass flooring system of claim 1, wherein each clip is a continuous clip with a length equal to or greater than 90% of a length of the flooring unit.

4. The fire rated glass flooring system of claim 3, wherein each continuous clip has an indented portion, the indented portion having a substantially flat portion substantially parallel to the length of the clip.

5. The fire rated glass flooring system of claim 1, wherein each clip comprises a substantially U-shaped portion and two outwardly-directed flanges extending from the prongs of the substantially U-shaped portion.

6. The fire rated glass flooring system of claim 5, wherein the middle section of the substantially U-shaped portion of each clip is secured to the load-transferring means of one of the plurality of glass flooring units.

7. The fire rated glass flooring system of claim 5, wherein in use, one of the two flanges points upward towards the upper surface of the units and the other of the two flanges points downwards.

8. The fire rated glass flooring system of claim 7 wherein the resilient seal is arranged, in use, to sit between the upward-pointing flanges of two adjacent clips.

9. The fire rated glass flooring system of claim 7, wherein the downward-pointing flanges are positioned above the drainage means and arranged, in use, to direct any liquid which passes the seal into the drainage means.

10. The fire rated glass flooring system of claim 1, wherein the load-transferring means of each flooring unit comprises a member that extends substantially horizontally and which is located between the first layer of glass which is a structural glass and the second layer of glass which is a fire rated glass.

11. The fire rated glass flooring system of claim 1, wherein the load-transferring means of each flooring unit comprises a hollow box.

12. The fire rated glass flooring system of claim 1, wherein the load-transferring means of each flooring unit is positioned on a part of the corresponding flooring unit which forms a plate, the plate being between the load-transferring means and the beam, and extending substantially horizontally from the edge of the load-transferring means nearest to the boundary between flooring units to beyond the opposite edge of the load-transferring means, and wherein a second resilient seal is arranged on the plate between the plate and a layer of glass which forms the lower surface of the remainder of the unit.

13. The fire rated glass flooring system of claim 12, wherein the second resilient seal is made of structural silicone.

14. The fire rated glass flooring system of claim 12, wherein the plate forms the lowest portion of the lower surface of the flooring unit, and extends substantially to the edge of the beam by which it is supported.

15. The fire rated glass flooring system of claim 1, wherein the drainage means is arranged, in use, to channel any liquid which passes the seal to one or more edges of an area covered by the flooring system.

16. The fire rated glass flooring system of claim 1, wherein the drainage means comprises a channel located substantially below the seal and the two clips, and running along the top of the beam, at the boundary between adjacent units.

17. The fire rated glass flooring system of claim 16, wherein each channel is sloped towards an edge of an area covered by the flooring system.

18. The fire rated glass flooring system of claim 1, wherein a replaceable sacrificial sheet is provided on the upper surface of the flooring system.

19. The fire rated glass flooring system of claim 1, wherein each flooring unit is sealed so as to be substantially air-tight.

20. The fire rated glass flooring system of claim 1, wherein the beam is a T-beam or an I-beam, and wherein the two adjacent flooring units are arranged, in use, to be secured to opposing flanges of the T or I beam.

21. The fire rated glass flooring system of claim 1, wherein the beam is a T-beam.

* * * * *